US006433766B1

(12) United States Patent
Chen

(10) Patent No.: US 6,433,766 B1
(45) Date of Patent: Aug. 13, 2002

(54) DATA TRANSMISSION METHOD AND DEVICE FOR REDUCING THE ELECTROMAGNETIC INTERFERENCE INTENSITY OF LIQUID CRYSTAL DISPLAY CIRCUIT

(75) Inventor: Yen-Chen Chen, Tainan (TW)

(73) Assignee: Chi Mei Optoelectronics Corporation, Tainan (TW)

( * ) Notice: Subject to any disclaimer, the term of this patent is extended or adjusted under 35 U.S.C. 154(b) by 250 days.

(21) Appl. No.: 09/603,813

(22) Filed: Jun. 26, 2000

(30) Foreign Application Priority Data

Feb. 3, 2000 (TW) ..... 89102157 A

(51) Int. Cl.[7] ..... G09G 3/36

(52) U.S. Cl. ..... 345/87; 345/90; 345/99; 345/100

(58) Field of Search ..... 345/87, 90, 98, 345/99, 100, 204

(56) References Cited

U.S. PATENT DOCUMENTS 5,990,857 A * 11/1999 Kubota et al. ..... 345/100
6,011,533 A * 1/2000 Aoki ..... 345/100
6,229,513 B1 * 5/2001 Nakano et al. ..... 345/100
6,252,572 B1 * 6/2001 Kurumisawa et al. ..... 345/100
6,295,046 B1 * 9/2001 Hebiguchi ..... 345/100

* cited by examiner

*Primary Examiner*—Bipin Shalwala
*Assistant Examiner*—Jimmy H. Nguyen
(74) *Attorney, Agent, or Firm*—Martine & Penilla, LLP

(57) ABSTRACT

A data transmission method for reducing the electromagnetic interference intensity of a liquid crystal display circuit comprises a pixel array, a clock signal generator for providing a plurality of clock signals, a data generator for providing a plurality of data sets, and a plurality of drivers. Each of the drivers receives a corresponding data set from the data generator and a clock signal from the clock signal generator, and transmits the corresponding data to the pixel array. The data transmission method is characterized in that the clock signal generator generates a plurality of clock signals with different frequencies. Each of the plurality of different frequencies is distributed around a central frequency and varied within a bandwidth of 5% of the central frequency. The clock signals have different frequencies at a given time, and the clock signals used by two adjacent drivers have different frequencies.

6 Claims, 3 Drawing Sheets

DATA TRANSMISSION METHOD AND DEVICE FOR REDUCING THE ELECTROMAGNETIC INTERFERENCE INTENSITY OF LIQUID CRYSTAL DISPLAY CIRCUIT

BACKGROUND OF THE INVENTION

1. Field of the Invention

The present invention relates to a data transmission method for reducing the effect of electromagnetic interference and a data transmission device with the reduced effect of electromagnetic interference. More particularly, the present invention relates to a data transmission method and device used in a liquid crystal display (LCD) circuit for reducing the electromagnetic interference intensity generated from data lines.

2. Description of the Related Art

When electrical and electronic devices are operated, they often emit and radiate electromagnetic radiation that interferes with other electronic devices' operations. For example, the electromagnetic radiation generated from other electrical and electronic devices may interfere with the operation of televisions, cordless phones, computers, and pagers, resulting in deteriorating the performance of these devices. This phenomenon is typically called electromagnetic interference (EMI), which is a critical concern for the design of electrical and electronic devices. Therefore, the U.S. Federal Communications Commission (FCC) has established a set of standards regarding EMI, which regulate electrical and electronic circuits, devices, and products. These regulations state that the EMI emissions of electronic circuits, devices and products should not be larger than the standard defined by the FCC in order to prevent the electrical and electronic circuits, devices, and products from influencing the operations of other electrical and electronic circuits, devices, and products.

Similarly, an LCD circuit is also subject to the effect of EMI when in operation. Hereafter a conventional LCD circuit structure and the EMI effect occurring therein are explained in conjunction with the accompanying diagrams.

FIG. 1 is a schematic diagram showing a conventional LCD circuit structure. Referring to FIG. 1, the conventional LCD circuit includes an i×j pixel array 11, an X driving circuit 12 electrically connected to the i×j pixel array 11, a Y driving circuit 13 electrically connected to the i×j pixel array 11, and a controller 14 electrically connected to the X driving circuit 12. More specifically, the i×j pixel array 11 is composed of i×j pixels (not shown). The X driving circuit 12 is composed of i driving units $X_1, X_2, \ldots, X_i$, in which each of the driving units $X_1, X_2, \ldots, X_i$, is driven by a clock signal CK and a data signal is sent to the pixel array 11 through a corresponding data line $L_1, L_2, \ldots$, or $L_i$, respectively. In addition, the Y driving circuit 13 is composed of j driving units $Y_1, Y_2, \ldots, Y_j$, in which each of the driving units $Y_1, Y_2, \ldots, Y_j$, sends a scanning signal to the i×j pixel array 11 through a corresponding scanning line $S_1, S_2, \ldots$, or $S_j$, respectively. Furthermore, through a data bus, the controller 14 sends both of data signals $D_1$ to $D_i$ and the clock signal CK to the X driving circuit 12.

In the above-mentioned conventional LCD circuit, the transmission frequencies of the data lines $L_1, L_2, \ldots, L_i$ are exactly the same, assuming that it is $f_0$ in this case, since each of the driving units $X_1, X_2, \ldots, X_i$ employs the same clock signal CK during the operation of data transmission. However, the same transmission frequency of the data signals $D_1$ to $D_i$ in the data lines $L_1, L_2, \ldots, L_i$ results in a significant EMI effect at several specific frequencies. In other words, the EMI effect primarily occurs at a fundamental frequency $f_0$ of the transmission frequency and its integral times $n \times f_0$ where n is a positive integral.

FIG. 2 is a schematic diagram showing an EMI spectrum of the conventional LCD circuit shown in FIG. 1. Referring to FIG. 2, the axis of abscissa represents a frequency with an arbitrary unit while the axis of ordinate represents EMI intensity with an arbitrary unit. As compared with the EMI spectrum of the conventional LCD circuit, the upper limit of EMI intensity defined by U.S. FCC is simultaneously shown in FIG. 2. It is observed from FIG. 2 that the EMI spectrum of the conventional LCD circuit has several discrete peaks at specific frequencies, namely, the fundamental frequency $f_0$ and harmonic frequencies $\mathbf{2}f_0, \mathbf{3}f_0, \ldots, nf_0$ due to the single frequency of the clock signal CK. For the sake of simplicity, however, only three EMI peaks are shown in FIG. 2. Among these EMI spectrum peaks, the maximum occurs at the fundamental frequency $f_0$ and the magnitudes of the EMI peaks tend to decrease along with the increase of frequency. Due to the fundamental peak $f_0$ and first harmonic peak $\mathbf{2}f_0$ exceeding the upper limit of EMI intensity defined by U.S. FCC, the conventional LCD circuit shown in FIG. 1 has no practical use.

SUMMARY OF THE INVENTION

In view of the foregoing, the object of the invention is to provide a data transmission method for reducing the electromagnetic interference intensity of an LCD circuit. The LCD circuit comprises a pixel array, a clock signal generator for providing a plurality of clock signals, a data generator for providing a plurality of data sets, and a plurality of drivers. Each of the drivers receives a data set sent from the data generator and a clock signal sent from the clock signal generator. The data set is then transmitted to the pixel array through a transmission line in response to the clock signal. The data transmission method is characterized by the clock signal generator's ability to generate a plurality of clock signals with different frequencies, each of which is distributed around a central frequency and varied within a bandwidth of 5% of the central frequency. Moreover, the clock signals have different frequencies from each other at a given time, and the clock signals used by two adjacent driving devices have different frequencies.

Furthermore, it is another object of the invention to provide a data transmission device for reducing the electromagnetic interference intensity of an LCD circuit, which comprises a pixel array, a controller, and a plurality of driving units. The controller provides a plurality of data sets and a plurality of clock signals with different frequencies, wherein each of the different frequencies is distributed around a central frequency and varied within a specific bandwidth, and the frequencies of the clock signals are different at a given time. Each of the driving units receives a corresponding data set from the data sets sent from the controller and one of the clock signals, and then transmits the data set through a transmission line to the pixel array in response to the clock signal, wherein the clock signals applied on two adjacent driving units of the driving units have different frequencies.

BRIEF DESCRIPTION OF THE DRAWINGS

The above-mentioned and other features and advantages of the present invention will be apparent from the following detailed description of preferred embodiments, which proceeds with reference to the accompanying drawings, in which.

DESCRIPTION OF PREFERRED EMBODIMENTS

The operating principles of the data transmission method for reducing the EMI intensity of an LCD circuit according to the present invention is explained in detail hereinafter by taking as an example data transmission over the LCD pixel array with reference to each accompanying drawing.

Figure 1:
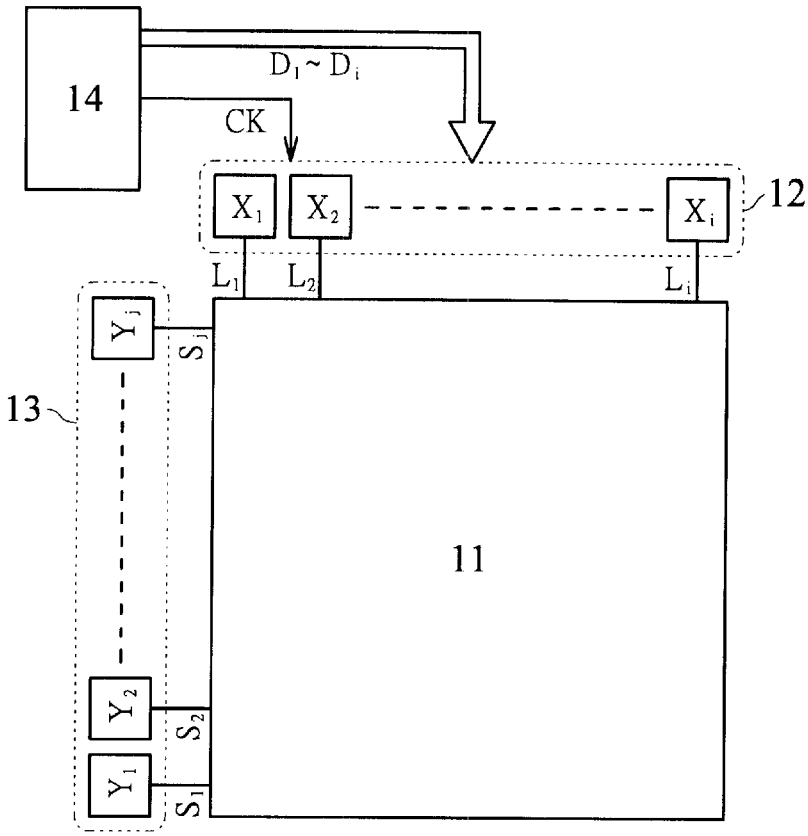
FIG. 1 (PRIOR ART)
FIG. 1 is a schematic diagram showing a structure of an LCD circuit according to the prior art.
Figure 2:
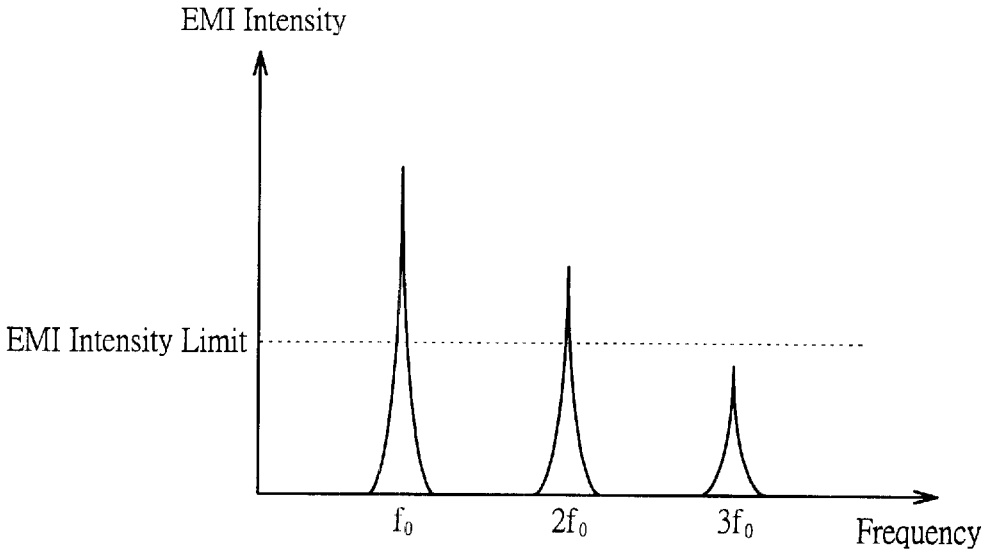
FIG. 2 (PRIOR ART)
FIG. 2 is an analysis diagram showing an EMI spectrum of the LCD circuit shown in FIG. 1.
Figure 3:
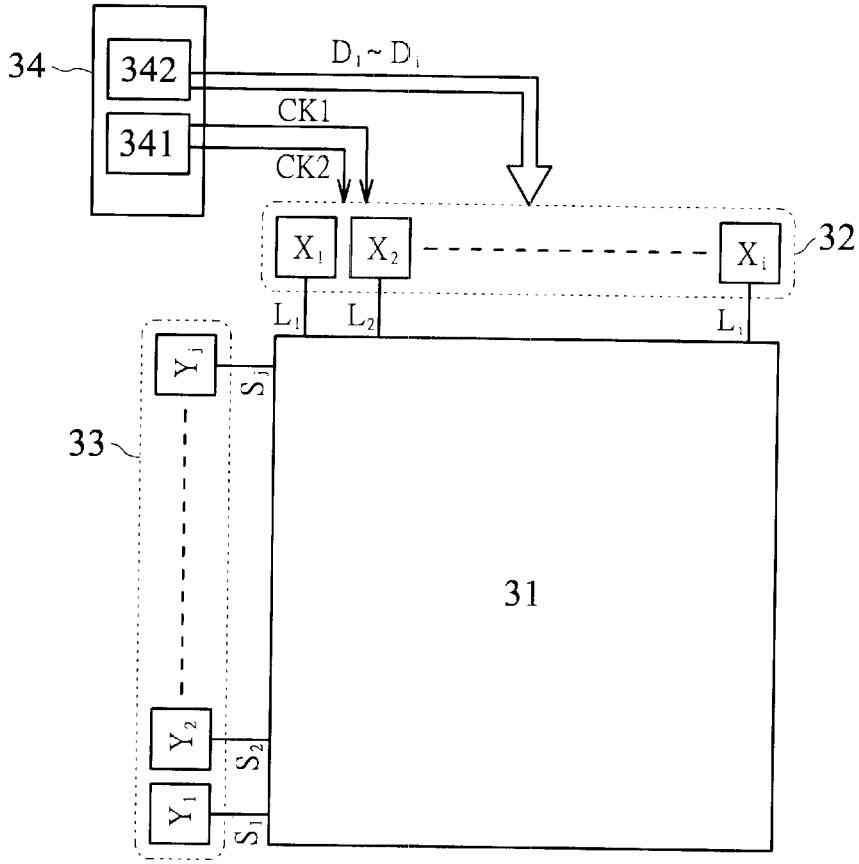
FIG. 3 is a schematic diagram showing a structure of an LCD circuit for reducing the EMI intensity according to the present invention.

FIG. 3 is a schematic diagram showing the data transmission method for reducing the EMI intensity of an LCD circuit according to the present invention. Referring to FIG. 3, with the application to the data transmission over the LCD pixel array as an example, the transmission device includes an i×j pixel array 31 composed of i×j pixels (not shown), an X driving circuit 32 electrically connected to the i×j pixel array 31, a Y driving circuit 33 electrically connected to the i×j pixel array 31, and a controller 34 electrically connected to the X driving circuit 32.

More specifically, the controller 34 includes a clock signal generator 341 electrically connected to the X driving circuit 32 for providing two clock signals CK1 and CK2 with different frequencies, and a data generator 342 electrically connected to the X driving circuit 32 for providing data signals $D_1$ to $D_i$ through a data bus. The X driving circuit 32 is composed of i driving units $X_1, X_2, X_3, \ldots, X_i$, which receive the data signals $D_1$ to $D_i$ and the two clock signals CK1 and CK2 from the controller 34 through the data bus, respectively. In the embodiment, each of the driving units $X_1, X_2, X_3, \ldots, X_i$ is alternately driven by the two clock signals CK1 and CK2, and then sends the data signals $D_1$ to $D_i$ towards the i×j pixel array 31 through a corresponding data line $L_1, L_2, \ldots$, or $L_i$. For example, the data signal $D_1$ is transmitted over the data line $L_1$ in response to the clock signal CK1 while the data signal $D_2$ is transmitted over the data line $L_2$ in response to the clock signal CK2. The Y driving circuit 33 is composed of j driving units $Y_1, Y_2, \ldots, Y_j$ wherein each of the driving units $Y_1, Y_2, \ldots, Y_j$ sends scanning signals to the i×j pixel array 31 through a corresponding scanning line $S_1, S_2, \ldots$, or $S_j$, respectively.

Figure 4:
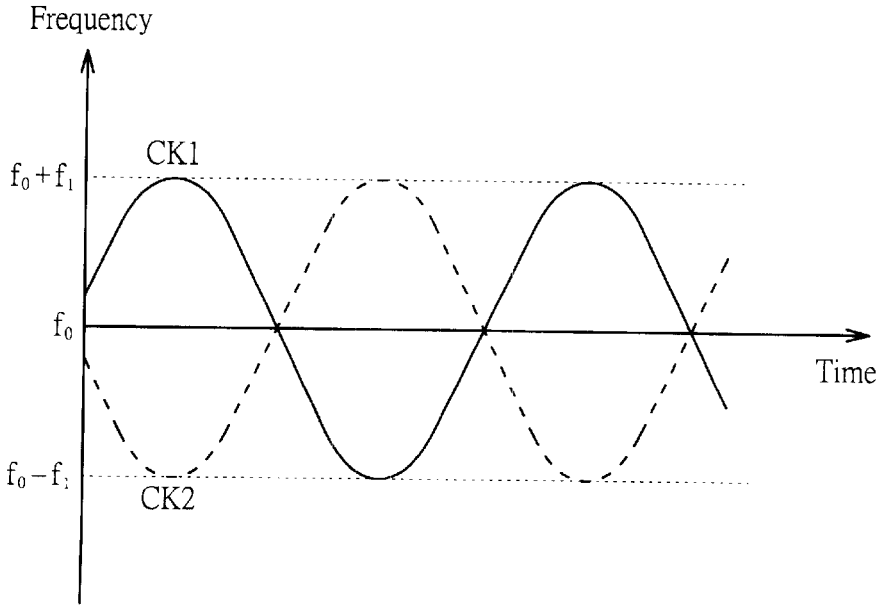
FIG. 4 shows a relationship between the frequencies of two clock signals CK1 and CK2 used in the data transmission device of the LCD circuit shown in FIG. 3.

FIG. 4 shows a relationship between the frequencies of two clock signals CK1 and CK2 used in the data transmission device of the LCD circuit shown in FIG. 3. Referring to FIG. 4, the axis of abscissa represents an operation time with an arbitrary unit while the axis of ordinate represents frequencies of the clock signals CK1 (illustrated by a solid curve) and CK2 (illustrated by a dot curve) with an arbitrary unit. In the embodiment, unlike a single and constant frequency of the clock signal used in the conventional LCD circuit, both of the clock signals CK1 and CK2 are signals with a spread spectrum of frequency, which are centralized at an operating frequency $f_0$ and varied within a bandwidth of $2f_1$ ($f_1$ is 5% of $f_0$, for example) along with a change of time. Furthermore, the frequencies of the two clock signals CK1 and CK2 are designed to be different from each other at a given time. In order to prevent differences of frequency in the overall transmission, the average frequency for respective clock signals CK1 and CK2 is equal to the desired operating frequency $f_0$.

Figure 5:
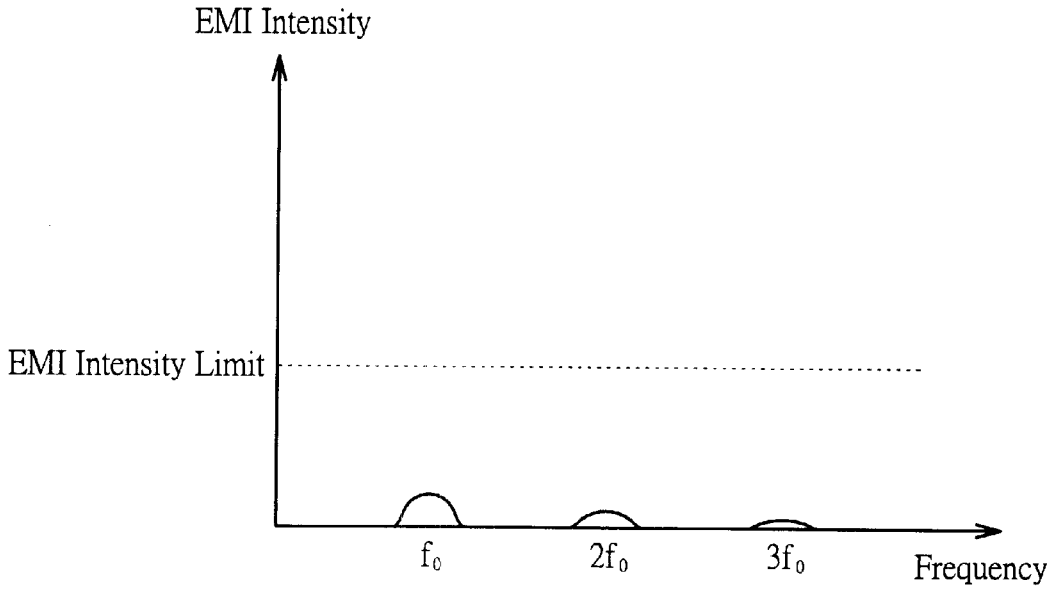
FIG. 5 is an analysis diagram showing an EMI spectrum of the LCD circuit shown in FIG. 3.

FIG. 5 is a schematic diagram showing the EMI spectrum of the LCD circuit shown in FIG. 3. Referring to FIG. 5, the axis of abscissa represents a frequency with an arbitrary unit while the axis of ordinate represents EMI intensity with an arbitrary unit. As compared with the EMI spectrum of the LCD circuit, the upper limit of EMI intensity defined by U.S. FCC is simultaneously shown in FIG. 5. It is observed from FIG. 5 that although the EMI spectrum of the LCD circuit has several discrete peaks at specific frequencies, namely, the fundamental frequency fo and harmonic frequencies $2f_0, 3f_0, \ldots, nf_0$, however, only three EMI peaks are shown in FIG. 5 for simplicity, the magnitudes of the EMI peaks are all considerably smaller than the upper limit of EMI intensity defined by U.S. FCC. In other words, the EMI intensities of the fundamental frequency $f_0$ and of the harmonic frequencies $2f_0, 3f_0, \ldots, nf_0$ for the LCD circuit using two clock signals CK1 and CK2 according to the present invention are effectively and greatly suppressed. This is not only because the clock signals CK1 and CK2 are both signals with a spread spectrum of frequency, and therefore the EMI emissions to a certain extent are attenuated, but also because adjacent data lines respond to the different clock signals CK1 and CK2 so that the EMI emissions generated, respectively, from the adjacent data lines do not occur at the same frequency. Furthermore, two non-adjacent data lines are far apart enough that the EMI intensity is relatively small even if they may respond to the same clock signals. Consequently, the EMI intensity of the whole circuit system is effectively and greatly reduced according to the present invention.

One that is skilled in the art recognizes that the present invention is not limited to use only two clock signals for driving the LCD circuit. An LCD circuit using three or more clock signals, each of which has a spread spectrum of frequency, should be construed as within the purview of the invention.

Furthermore, One that is skilled in the art knows that the clock signals CK1 and CK2 are not limited to ones with a spread spectrum of frequency as shown in FIG. 4. Any other signal with a spread spectrum of frequency in any reasonable profile is still within the scope of the invention.

While the invention has been described by way of example and in terms of the preferred embodiment, it is to be understood that the invention is not limited to the disclosed embodiment. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A data transmission method for reducing the electromagnetic interference intensity of a liquid crystal display (LCD) circuit, of which the LCD circuit comprises:

a pixel array;

a clock signal generator for providing a plurality of clock signals;

a data generator for providing a plurality of data sets; and a plurality of drivers, each of the drivers receives both a corresponding data set in the plurality of data sets sent from the data generator and one of the plurality of clock signals sent from the clock signal generator, and transmits the corresponding data set to the pixel array through a transmission line in response to the clock signal received from the clock signal generator, wherein the data transmission method is characterized in that the plurality of clock signals generated from the clock signal generator have different frequencies, each of which is distributed around a central frequency;

the plurality of clock signals have different frequencies from each other at a given time; and the plurality of clock signals used by two adjacent drivers have different frequencies.

2. A data transmission method as set forth in claim 1, wherein each of the different frequencies is varied within a bandwidth of 5% of the central frequency.

3. A data transmission method as set forth in claim 1, wherein the clock signal generator generates two clock signals with different frequencies.

4. A data transmission device for reducing the electromagnetic interference intensity of a liquid crystal display (LCD) circuit, comprising:

a pixel array;

a controller for providing a plurality of data sets and a plurality of clock signals with different frequencies, wherein each of the plurality of different frequencies is distributed around a central frequency, and the frequencies of the plurality of clock signals are different at a given time; and a plurality of driving units, each of which receives both a corresponding data set in the plurality of data sets sent from the controller and one of the plurality of clock signals, and transmits the data set through a transmission line to the pixel array in response to the clock signal, wherein two adjacent driving units of the plurality of driving units use two clock signals with different frequencies.

5. A data transmission device as set forth in claim 4, wherein each of different frequencies is varied within a specific bandwidth of 5% of the central frequency.

6. A data transmission device as set forth in claim 4, wherein the controller generates two clock signals with different frequencies.

* * * * *